US008221519B2

(12) United States Patent
Poulalion et al.

(10) Patent No.: US 8,221,519 B2
(45) Date of Patent: Jul. 17, 2012

(54) POWDER FOR SULPHUR-BASED FLUX-CORED WIRE, FLUX-CORED WIRE AND METHOD FOR PRODUCING A FLUX-CORED WIRE USING IT

(75) Inventors: Andre Poulalion, Saint Chely d'Apcher (FR); Sebastien Gerardin, Arras (FR); Vincent Moreschi, Hautmont (FR)

(73) Assignee: Affival, Solesmes (FR)

( * ) Notice: Subject to any disclaimer, the term of this patent is extended or adjusted under 35 U.S.C. 154(b) by 45 days.

(21) Appl. No.: 12/760,747

(22) Filed: Apr. 15, 2010

(65) Prior Publication Data

US 2010/0263485 A1 Oct. 21, 2010

(30) Foreign Application Priority Data

Apr. 16, 2009 (FR) ..... 09 52481

(51) Int. Cl.
*B23K 35/22* (2006.01)
*B22F 3/02* (2006.01)

(52) U.S. Cl. ..... 75/303; 75/304; 75/313; 75/330; 423/567.1; 23/293 S; 219/145.22; 219/146.31

(58) Field of Classification Search ..... 75/303, 75/304, 313, 330; 423/567.1; 23/293 S; 219/145.22, 146.31
See application file for complete search history.

(56) References Cited

U.S. PATENT DOCUMENTS 5,071,332 A * 12/1991 Garcia et al. ..... 425/6
7,906,747 B2 * 3/2011 Poulalion ..... 219/145.22

FOREIGN PATENT DOCUMENTS

JP 52-101621 A 8/1977
JP 55117590 A * 9/1980
JP 2002-363691 A 12/2002
WO 2008/144627 A1 11/2008

OTHER PUBLICATIONS

Modern Process Equipment. "Resources: Particle Size Conversion Table". Copyright 2011 http://www.mpechicago.com/grinders/resources_conversion.html downloaded Aug. 10, 2011.*

French Search Report, dated Aug. 24, 2009, from corresponding French application.

* cited by examiner

*Primary Examiner* — George Wyszomierski
*Assistant Examiner* — Tima M McGuthry Banks
(74) *Attorney, Agent, or Firm* — Young & Thompson

(57) ABSTRACT

Powder which is for a flux-cored wire intended to become alloyed with a molten metal bath and which is formed by particles composed with at least 95% of sulphur, characterised in that its granulometric population is defined by: −1 μm≦d10≦340 μm; −200 μm d50≦2000 μm; −500 μm d90≦2900 μm. Sulphur-based flux-cored wire, characterised in that it contains the preceding powder, and in that the compaction rate of the powder within the wire is greater than or equal to 85%. Method for producing a sulphur-based flux-cored wire for alloying with molten metal baths.

10 Claims, No Drawings

POWDER FOR SULPHUR-BASED FLUX-CORED WIRE, FLUX-CORED WIRE AND METHOD FOR PRODUCING A FLUX-CORED WIRE USING IT

BACKGROUND OF THE INVENTION

2. Field of the Invention

The invention relates to the field of metallurgy, and more specifically flux-cored wires, by means of which sulphur is introduced to baths of molten metal, in particular steel and metal alloys.

2. Description of the Related Art

Flux-cored wire with sulphur powder is introduced into molten steel in order to improve the machinability of the final steel by promoting the formation of brittle chips which are removed more rapidly when the components are machined. Sulphur further reduces wear of cutting tools owing to the lubrication effect brought about by non-metallic inclusions which contain it and improves the surface condition of those tools. Addition by means of flux-cored wire allows satisfactory precision to be achieved concerning the quantity of sulphur added, particularly if it must be a relatively small amount in relation to the total mass of molten metal involved.

Such a flux-cored wire is composed of a metal sheath containing a compacted sulphur-based powder. The production of the wire, as for flux-cored wires containing other types of additive, such as calcium silicate, may conventionally begin with powdered sulphur being dispensed by means of gravitational force onto a moving metal strip. The strip must have a composition which is compatible with that of the metal, to which the strip has to be added. It is of steel when sulphur has to be added to a bath of molten steel. The strip is then welded or folded on itself by mechanical profiling by means of a roller type device in order to obtain a flux-cored wire which is subsequently calibrated to the desired diameter.

Other methods for preparing flux-cored wire are known, some of which use techniques involving extrusion and cold-rolling.

SUMMARY OF THE INVENTION

The invention applies primarily to wires which are produced by mechanical profiling but it is not a priori impossible to use the powder according to the invention which will be described below to produce flux-cored wires by other methods.

The production of the flux-cored wire involves several types of mechanical stresses, in particular shearing stresses. The sulphur powder is subjected to various deformations during the production of the wire in accordance with the intrinsic mechanical characteristics thereof. The powder densifies in the cold state at various rates by those stresses being applied.

The origin and the methods for extracting sulphur are very varied (extraction in the native state, from minerals, from petroleum products, etc.). Sulphur exists as different crystallised allotropic varieties, in particular orthorhombic $\alpha$ and monoclinic $\beta$ sulphurs. The sulphur which constitutes the flux-cored wire used in metallurgy, in particular for steel and ferrous alloys, conventionally has a purity greater than 95%, generally greater than 98% or 99.5%. A flux-cored wire of sulphur powder conventionally has an outer diameter of from 5 to 25 mm and a sheath thickness of from 0.1 to 2 mm.

The sulphur powder contained in the flux-cored wire is the product of several crushing operations. This results in granulometric distribution suitable for the industrial method of obtaining powders.

For the user, it is advantageous for the mass per unit length of sulphur contained in the flux-cored wire to be as high as possible. The increase in the mass per unit length of the flux-cored wire affords the user a plurality of technical and economic advantages:

- substantial economy concerning the production costs of the flux-cored wire and therefore the purchase price thereof;
- economy concerning the logistics expenses during transport of the flux-cored wire;
- economy concerning the storage space of the coils of flux-cored wire;
- better diffusion of the material contained in the flux-cored wire within the molten metal owing to the presence of fine particles;
- limiting the addition of gas introduced inside the baths of molten metals in order to agitate the bath promoting the dilution of additives;
- an absence of any binding and/or lubricating agent in the original material.

Until now, to the knowledge of the applicant, there has been no specific work relating to the optimisation of the filling of the flux-cored wire. Therefore, each commercially available flux-cored wire has a mass per unit length in accordance with the production method and the initial physical characteristics of the powders.

An object of the invention is to provide a method for producing sulphur-based flux-cored wire which allows the mass per unit length of the flux-cored wire to be optimised.

To that end, the invention relates to a powder which is for a flux-cored wire intended to become alloyed with a molten metal bath and which is formed by particles composed with at least 95% of sulphur, characterised in that its granulometric population is defined by:

$1\ \mu m \leqq d10 \leqq 340\ \mu m$;

$200\ \mu m \leqq d50 \leqq 2000\ \mu m$;

$500\ \mu m \leqq d90 \leqq 2900\ \mu m$.

A preferred variant of this powder is characterised in that:

$20\ \mu m \leqq d10 \leqq 300\ \mu m$;

$800\ \mu m \leqq d50 \leqq 1900\ \mu m$;

$2000\ \mu m \leqq d90 \leqq 2700\ \mu m$.

The powder may result from the homogeneous admixture of two granulometric populations 1 and 2, granulometric population 1 constituting between 50 and 90% by mass of the admixture and population 2 constituting between 10 and 50% by mass of the admixture, the populations being defined by:

Population 1:

$350\ \mu m \leqq d10 \leqq 1400\ \mu m$ $650\ \mu m \leqq d50 \leqq 2200\ \mu m$ $1000\ \mu m \leqq d90 \leqq 3000\ \mu m$ Population 2:

$1\ \mu m \leqq d10 \leqq 250\ \mu m$ $50\ \mu m \leqq d50 \leqq 500\ \mu m$ $100\ \mu m \leqq d90 \leqq 800\ \mu m$ d10, d50 and d90 being the equivalent diameters of the particles for which the values of the cumulative distributions are 10, 50 and 90% by mass, respectively.

Population 1 optimally constitutes from 65 to 75% by mass of the admixture and population 2 optimally constitutes from 25 to 35% by mass of the admixture.

The invention also relates to a sulphur-based flux-cored wire intended for alloying with a metal bath, characterised in that it contains a powder of the above type, and in that the compaction rate of the powder within the wire is greater than or equal to 85%.

The invention also relates to a method for producing a sulphur-based flux-cored wire for alloying with molten metal baths, characterised in that it comprises the following steps of:

preparing a powder of the above type;

dispensing the powder by gravitational force onto a metal strip;

welding or mechanically folding the strip on itself in order to form the wire and profiling the wire to the selected diameter so as to obtain a wire whose powder compactness is greater than or equal to 85%.

As will be appreciated, the invention is based on a specific constitution of the powder in that it has a precise granulometric distribution which results or may result from an admixture in predetermined proportions of two defined and differentiated granulometric populations, even if it is not strictly excluded that they can sometimes slightly overlap.

The advantage of the invention is the introduction of a maximum powder mass within the flux-cored wire with a constant cross-section. This allows a reduction in the intergranular porosity of the final compact admixture.

DETAILED DESCRIPTON OF THE INVENTION

A granular assembly may be characterised by its aptitude for rearrangements following a discharge or vibration operation. The assembly becomes rearranged more or less well in accordance with the physical characteristics of the particles and the bed of particles: particle size, true density of the powdered material, morphology of the particles, compressibility of the granular assembly, size distribution of the particles.

The quality of the granular stacking after a discharge and/or vibration operation influences the filling level of the flux-cored wire. The granular rearrangement is more or less random. It mainly depends on the morphology, the size and the surface appearance of the particles. The innovation brought about by the invention involves optimising and improving the stacking in order to obtain the best possible filling level whilst maintaining the final mechanical characteristics of the wire. It is also necessary to take into consideration the intrinsic properties of the filling material, which cause the material to react in a specific manner to the constraints to which it will be subjected during the production of the wire, particularly during the steps of closing and welding or profiling the sheath. In particular for this reason, the problem of optimising the mass per unit length of the final flux-cored wire cannot have a single solution which is applicable whatever the filling material. The optimisation must be finely adjusted in accordance with the exact nature of the material.

By means of a series of experiments and various analyses of the results obtained, the inventors have established what they consider to be the best granulometric distribution for optimum filling of the flux-cored wire by sulphur particles. The granulometric distribution develops a dense stacking whilst conferring a ready flowing action on the powder bed during deposit of the powder on the metal strip when the wire is produced. The flowability of the granular assembly is characterised by the Hausner index and the compressibility index.

The compressibility of a granular medium is linked to the flow properties because it represents the intergranular forces, and therefore indirectly the cohesion of the medium. The greater the interparticular forces, the more the medium will be able to become compressed provided that the impacts applied are sufficiently energetic.

The compressibility index is established by the ratio of the aerated and compressed densities:

$$\text{Compressibility}=(\rho_{compressed}-\rho_{aerated})/\rho_{compressed}$$

where:

$\rho_{compressed}$ is the apparent compressed density, $\rho_{aerated}$ is the apparent non-compressed density.

The Hausner index $I_H$ which is always greater than 1 increases when the flow speed decreases, therefore when the interparticular friction becomes greater. It is affected by the morphology, appearance, size, density of the powder and residual humidity. It is defined by:

$$I_H=\rho_{compressed}/\rho_{aerated}$$

During a random granular rearrangement, a reduction in the intergranular porosity results after gravitational flow.

The granulometric populations which constitute the admixture resulting from the invention are defined as set out below:

1 μm≦d10×340 μm;

200 μm≦d50≦2000 μm;

500 μm≦d90≦2900 μm.

A preferred variant of this admixture is defined by:

20 μm d10≦300 μm;

800 μm≦d50≦1900 μm;

2000 μm≦d90≦2700 μm.

The density in the compressed state resulting from that granular assembly is in the order of from 1.0 to 1.70 g/cm$^3$. The morphology of the sulphur particles may equally be spherical or rounded, needle-like, fibre-like or polyhedral. The compaction rate within the flux-cored wire is usually in the order of from 75 to 80% whereas in the invention a compaction rate of at least 85% is attained.

Preferably, this powder is obtained by associating in an optimised manner a plurality of separate granulometric populations of sulphur particles which have a purity of at least 95%, preferably greater than 98% and whose sizes are within the range [0-5000 μm] applied to the flux-cored wire. The association is a homogeneous admixture of various precise mass proportions, for each population, conventionally obtained by means of a granular agitation device with a rotating vessel. The granulometric distributions of the populations of the invention are defined by the indexes d10, d50, d90:

the index d10 defines the equivalent diameter for which the value of the cumulative distribution is 10% by mass;

the index d50 defines the equivalent diameter for which the value of the cumulative distribution is 50% by mass;

the index d90 defines the equivalent diameter for which the value of the cumulative distribution is 90% by mass.

Based on admixtures of those granulometric populations, an increase in the filling level of from 10 to 70% of the mass per unit length is typically obtained in relation to a wire having the same diameter, using the same sheath and produced under the same conditions by means of any one of those populations. The compaction rate of those sulphur-based flux-cored wires after the production of the wire is, according to the invention, greater than or equal to 85% in order to reach an optimum mass per unit length.

The granulometric populations which the inventors have established correspond to a preferred version of the invention and in which two populations 1 and 2 are used are described as follows:

Population 1:

350 μm≦d10≦1400 μm

650 μm≦d50≦2200 μm

1000 μm≦d90≦3000 μm

Population 2:

1 μm≦d10≦250 μm

50 μm≦d50≦500 μm

100 μm≦d90≦800 μm

The experimental protocol used in the laboratory is firstly to mix populations having a given granulometric distribution in precise mass proportions. Subsequently, the physical characteristics of the different admixtures, such as the size distribution of grains and density, are measured. Those data thus allow a behavioural and phenomenological modelling of the system to be put in place.

The models obtained indicate associations of mass and granulometry proportions that are ideal. Granular selection is carried out upstream in order to advantageously distribute the granulometric classes. Finally, the optimum granulometric distribution is composed of an association of a plurality of size classes.

Those admixtures tested on the industrial production method of the flux-cored wire allow confirmation of the modelling phase of the laboratory experiment. For example, the optimum admixture is composed of from 65 to 75% by mass of population 1 mixed homogeneously with from 25 to 35% by mass of population 2. An admixture is considered to be optimum when it has the highest levels of flow capacity and compactness.

Those admixtures are produced using a rotary vessel mixer of a conventional, commercially available type. The internal walls of the mixer are composed of spouts which are fixed advantageously in order to limit the granular heterogeneity. In this manner, they allow the materials to be agitated gently without substantial modification of the size of the particles of the powder bed. The homogeneity of the admixture is ensured for a mixing time of from 1 to 10 minutes.

The compaction rate of the powders within the flux-cored wire is established by the physical characterisation of a plurality of representative samples by the mercury intrusion porosimetry technique. That destructive analysis allows measurement of the size distribution of pores of the intragranular and intergranular open porosity. At the same time, the theoretical density of a powdered material is measured by helium pycnometry. In this manner, that allows an evaluation of the compaction rate and the porosity level of the granular assembly within the flux-cored wire.

The flux-cored wire is technically characterised particularly by its mass per unit length, in accordance with its filling degree. The filling degree results from the density of the powdered or granular population which composes it. The conventional sulphur-based flux-cored wire with a steel sheath, having an outer diameter of between 13 and 14 mm, has a mass per unit length in the range [180 g/m-205 g/m]. The conventional granulometric distribution of the powder which it contains is in the range [0 μm-5000 μm].

There will now be described examples of known sulphur-based flux-cored wires for reference and sulphur-based flux-cored wires according to the invention which will demonstrate the advantages of the invention. The wires have been produced by the method selected in the invention involving deposit of the powder on a metal strip, welding or folding the strip on itself in order to form the wire and profiling the wire to bring it to the nominal diameter thereof.

REFERENCE EXAMPLE 1

Production of a Flux-Cored Wire of Sulphur Powder which is Standard and Known and has an Outer Diameter of 13.1 mm with a Strip Having a Thickness of 0.39 mm For a population A whose granulometric distribution and characteristics are set out below:

TABLE NO. 1

Granulometric distribution of population A in accordance with the standard ASTM E11-01

| Size class (mm) | Percentage |
|---|---|
| <0.045 | 0.2 |
| 0.045-0.075 | 0.2 |
| 0.075-0.100 | 0.2 |
| 0.100-0.150 | 0.3 |
| 0.150-0.200 | 0.2 |
| 0.200-0.250 | 0.2 |
| 0.250-0.300 | 0.1 |
| 0.300-0.425 | 0.5 |
| 0.425-0.500 | 0.1 |
| 0.500-0.630 | 1.3 |
| 0.630-0.800 | 3.4 |
| 0.800-1.000 | 4.3 |
| 1.000-1.250 | 10.0 |
| 1.250-1.400 | 8.6 |
| 1.400-1.600 | 0.1 |
| 1.600-2.000 | 34.9 |
| 2.000-2.360 | 28.6 |
| 2.360-2.800 | 6.3 |
| 2.800-3.350 | 0.5 |

Purity of the population: S=99.95%;

Pycnometric density: 2.02 g/cm$^3$;

Compressed density: 1.18 g/cm$^3$;

Aerated density: 1.09 g/cm$^3$;

Compressibility index: 7.62%;

Hausner index: 1.08;

d10 between 0.800 and 1.000 mm;

d50 between 1.600 and 2.000 mm;

d90 between 2.000 and 2.360 mm.

The mass per unit length developed within the flux-cored wire produced from that single population A, of which d10 is too high to be in accordance with the invention, is 189 g/m with a compaction rate of 78%.

EXAMPLE 2

Corresponding to the Invention: Production of a Flux-Cored Wire of Sulphur Powder Having an Outer Diameter of 13.1 mm with a Strip Having a Thickness of 0.39 mm Another population B of powder is used, whose granulometric distribution and characteristics are set out below:

TABLE NO. 2

Granulometric distribution of population B in accordance with the standard ASTM E11-01

| Size class (mm) | Percentage |
|---|---|
| <0.045 | 3.8 |
| 0.045-0.075 | 7.8 |
| 0.075-0.100 | 9.9 |
| 0.100-0.150 | 12.9 |
| 0.150-0.200 | 14.7 |
| 0.200-0.250 | 12.9 |
| 0.250-0.300 | 10.9 |
| 0.300-0.425 | 23.1 |
| 0.425-0.500 | 3.6 |
| 0.500-0.630 | 0.3 |
| 0.630-0.800 | 0.1 |
| 0.800-1.000 | 0.1 |
| 1.000-1.250 | 0.1 |
| 1.250-1.400 | 0.0 |
| 1.400-1.600 | 0.0 |
| 1.600-2.000 | 0.0 |
| 2.000-2.360 | 0.0 |

TABLE NO. 2-continued

| Granulometric distribution of population B in accordance with the standard ASTM E11-01 | |
|---|---|
| Size class (mm) | Percentage |
| 2.360-2.800 | 0.0 |
| 2.800-3.350 | 0.0 |

Purity of the population: S=99.95%;
Pycnometric density: 2.02 g/cm$^3$;
Compressed density: 1.13 g/cm$^3$;
Aerated density: 0.90 g/cm$^3$;
Compressibility index: 20.35%;
Hausner index: 1.25;
d10 between 0.045 and 0.075 mm;
d50 between 0.200 and 0.250 mm;
d90 between 0.300 and 0.425 mm.

Since the flow indexes of this powder are mediocre (high compressibility index and Hausner index), this powder alone, for which d90 is too low for it to be in accordance with the invention, does not allow a flux-cored wire to be obtained having a regular mass per unit length under normal production conditions.

For an admixture forming a population C constituted by 70% by mass of batch A and 30% by mass of batch B whose granulometric distribution and characteristics are set out below:

TABLE NO. 3

| Granulometric distribution of population C in accordance with the standard ASTM E11-01 | |
|---|---|
| Size class (mm) | Percentage |
| <0.045 | 0.0 |
| 0.045-0.075 | 2.5 |
| 0.075-0.100 | 2.9 |
| 0.100-0.150 | 4.8 |
| 0.150-0.200 | 5.2 |
| 0.200-0.250 | 4.2 |
| 0.250-0.300 | 3.6 |
| 0.300-0.425 | 7.5 |
| 0.425-0.500 | 2.2 |
| 0.500-0.630 | 2.3 |
| 0.630-0.800 | 3.3 |
| 0.800-1.000 | 3.2 |
| 1.000-1.250 | 8.0 |
| 1.250-1.400 | 1.2 |
| 1.400-1.600 | 2.9 |
| 1.600-2.000 | 23.2 |
| 2.000-2.360 | 18.4 |
| 2.360-2.800 | 4.4 |
| 2.800-3.350 | 0.2 |

Pycnometric density: 2.02 g/cm$^3$;
Compressed density: 1.47 g/cm$^3$;
Aerated density: 1.25 g/cm$^3$;
Compressibility index: 14.96%;
Hausner index: 1.17;
d10 between 0.100 and 0.150 mm;
d50 between 1.250 and 1.400 mm;
d90 between 2.000 and 2.360 mm.

There is obtained a wire having a mass per unit length of 237 g/m and a compaction rate of 88%. The mass per unit length is 25% greater than that of a similar wire having the same outer diameter of 13.1 mm and a strip thickness of 0.39 mm produced under the same conditions only from population A, although that population A has been mixed with population B which, taken separately, would not have led to satisfactory results owing to its poor pourability.

EXAMPLE 3

Corresponding to the Invention: Production of a Flux-Cored Wire of Sulphur Powder Having an Outer Diameter of 13.1 mm with a Strip Thickness of 0.39 mm A sulphur powder constitutes a population D and has the following granulometric distribution and characteristics:

TABLE NO. 4

| Granulometric distribution of population D in accordance with the standard ASTM E11-01 | |
|---|---|
| Size class (mm) | Percentage |
| <0.045 | 0.1 |
| 0.045-0.075 | 0.2 |
| 0.075-0.100 | 0.2 |
| 0.100-0.150 | 0.2 |
| 0.150-0.200 | 0.2 |
| 0.200-0.250 | 0.2 |
| 0.250-0.300 | 0.2 |
| 0.300-0.425 | 0.9 |
| 0.425-0.500 | 0.9 |
| 0.500-0.630 | 2.3 |
| 0.630-0.800 | 4.3 |
| 0.800-1.000 | 6.6 |
| 1.000-1.250 | 12.1 |
| 1.250-1.400 | 7.2 |
| 1.400-1.600 | 0.5 |
| 1.600-2.000 | 31.6 |
| 2.000-2.360 | 20.1 |
| 2.360-2.800 | 11.9 |
| 2.800-3.350 | 0.2 |

Purity of the population: S=99.95%;
Pycnometric density: 2.02 g/cm$^3$;
Compressed density: 1.14 g/cm$^3$;
Aerated density: 1.03 g/cm$^3$;
Compressibility index: 9.64%;
Hausner index: 1.10;
d10 between 0.800 and 1.000 mm;
d50 between 1.600 and 2.000 mm;
d90 between 2.360 and 2.800 mm.

Using only population D, for which d10 is higher than the invention demands, allows a flux-cored wire to be obtained having an outer diameter of 13.1 mm with a strip of 0.39 mm whose mass per unit length is 181 g/m with a compaction rate of 76%.

There is produced an admixture forming a population E constituted by 60% by mass of population D and 40% by mass of population B and which has the following granulometric distribution and characteristics:

TABLE NO. 5

| Granulometric distribution of population E in accordance with the standard ASTM E11-01 | |
|---|---|
| Size class (mm) | Percentage |
| <0.045 | 3.8 |
| 0.045-0.075 | 5.5 |
| 0.075-0.100 | 3.5 |
| 0.100-0.150 | 5.3 |
| 0.150-0.200 | 4.7 |
| 0.200-0.250 | 3.6 |
| 0.250-0.300 | 3.4 |

TABLE NO. 5-continued

| Granulometric distribution of population E in accordance with the standard ASTM E11-01 | |
|---|---|
| Size class (mm) | Percentage |
| 0.300-0.425 | 5.8 |
| 0.425-0.500 | 0.4 |
| 0.500-0.630 | 1.3 |
| 0.630-0.800 | 0.7 |
| 0.800-1.000 | 2.5 |
| 1.000-1.250 | 2.8 |
| 1.250-1.400 | 2.6 |
| 1.400-1.600 | 0.2 |
| 1.600-2.000 | 17.7 |
| 2.000-2.360 | 24.9 |
| 2.360-2.800 | 11.0 |
| 2.800-3.350 | 0.1 |

Pycnometric density: 2.02 g/cm$^3$;
Compressed density: 1.43 g/cm$^3$;
Aerated density: 1.16 g/cm$^3$;
Compressibility index: 18.80%;
Hausner index: 1.23;
d10 between 0.075 and 0.100 mm;
d50 between 1.600 and 2.000 mm;
d90 between 2.360 and 2.800 mm.

Using population E allows a flux-cored wire to be obtained having a mass per unit length of 225 g/m, 24% greater than that obtained with population D alone and a compaction rate of 86%. In this case too, mixing population D with population B at the given proportions allowed a flux-cored wire of 13.1 mm to be obtained with a strip of 0.39 mm produced under the same conditions, having far better characteristics than using only population D would have permitted.

However, it will be appreciated that the compactness and the mass per unit length of this flux-cored wire are slightly less than those of the wire of example 2. That is because d90 of population E is higher than that of population C and does not necessarily fall within the preferred range of the invention.

REFERENCE EXAMPLE 4

Production of a Flux-Cored Wire of Sulphur Powder Having an Outer Diameter of 9.2 mm with a Strip Thickness of 0.20 mm A sulphur powder constitutes a population F whose granulometric distribution and characteristics are as follows:

TABLE NO. 6

| Granulometric distribution of population F in accordance with the standard ASTM E11-01 | |
|---|---|
| Size class (mm) | Percentage |
| <0.045 | 0.0 |
| 0.045-0.075 | 0.0 |
| 0.075-0.100 | 0.0 |
| 0.100-0.150 | 0.1 |
| 0.150-0.200 | 0.1 |
| 0.200-0.250 | 0.7 |
| 0.250-0.300 | 1.4 |
| 0.300-0.425 | 3.8 |
| 0.425-0.500 | 3.0 |
| 0.500-0.630 | 6.2 |
| 0.630-0.800 | 10.1 |
| 0.800-1.000 | 13.0 |
| 1.000-1.250 | 20.5 |
| 1.250-1.400 | 10.0 |

TABLE NO. 6-continued

| Granulometric distribution of population F in accordance with the standard ASTM E11-01 | |
|---|---|
| Size class (mm) | Percentage |
| 1.400-1.600 | 9.4 |
| 1.600-2.000 | 20.7 |
| >2.000 | 1.0 |

Purity of the population: S=99.95%;
Pycnometric density: 2.02 g/cm$^3$;
Compressed density: 1.14 g/cm$^3$;
Aerated density: 1.01 g/cm$^3$;
Compressibility index: 11.40%;
Hausner index: 1.13;
d10 between 0.500 and 0.630 mm;
d50 between 1.000 and 1.250 mm;
d90 between 1.600 and 2.000 mm.

Using only population F, for which d10 is higher than the invention demands, allows a flux-cored wire to be obtained which has a diameter of 9.2 mm with a strip thickness of 0.20 mm and whose mass per unit length is 82 g/m with a compaction rate of 75%.

EXAMPLE 5

According to the Invention: Production of a Flux-Cored Wire of Sulphur Powder Having an Outer Diameter of 9.2 mm with a Strip Thickness of 0.20 mm.

There is produced an admixture which is constituted by 70% by mass of population A and 30% by mass of population B in accordance with population C described in example 2.

Using the population C to produce a flux-cored wire having an outer diameter of 9.2 mm with a strip thickness of 0.20 mm as in reference example 4 and under the same conditions allows a wire to be obtained having a mass per unit length of 109 g/m, 29% greater than that of reference example 4 produced only from population F, and a compaction rate of 89%.

The invention claimed is:

1. A powder for a flux-cored wire intended to become alloyed with a molten metal bath and which is formed by particles composed with at least 95% of sulphur, the powder comprising:

a granulometric population defined by:

1 μm d10≦340 μm;

200 μm d50≦2000 μm; and

500 μm d90≦2900 μm, where d10, d50 and d90 are equivalent diameters of the particles for which values of the cumulative distributions are 10, 50 and 90% by mass, respectively.

2. The powder according to claim 1, wherein the granulometric population is defined by:

20 μm≦d10≦300 μm;

800 μm≦d50≦1900 μm;

2000 μm≦d90≦2700 μm.

3. The powder according to claim 2, wherein the powder results from a homogeneous admixture of two granulometric populations 1 and 2, granulometric population 1 constituting between 50 and 90% by mass of the admixture and population 2 constituting between 10 and 50% by mass of the admixture, the populations being defined by:

Population 1:

350 μm≦d10≦1400 μm

650 μm≦d50≦2200 μm

1000 μm≦d90≦3000 μm

Population 2:

1 μm≦d10≦250 μm

50 μm≦d50≦500 μm

100 μm≦d90≦800 μm.

4. The powder according to claim 3, wherein population 1 constitutes from 65 to 75% by mass of the admixture and population 2 constitutes from 25 to 35% by mass of the admixture.

5. The powder according to claim 1, wherein the powder results from a homogeneous admixture of two granulometric populations 1 and 2, granulometric population 1 constituting between 50 and 90% by mass of the admixture and population 2 constituting between 10 and 50% by mass of the admixture, the populations being defined by:

Population 1:

350 μm≦d10≦1400 μm

650 μm≦d50≦2200 μm

1000 μm≦d90≦3000 μm

Population 2:

1 μm≦d10≦250 μm

50 μm≦d50≦500 μm

100 μm≦d90≦800 μm.

6. The powder according to claim 5, wherein population 1 constitutes from 65 to 75% by mass of the admixture and population 2 constitutes from 25 to 35% by mass of the admixture.

7. A method for producing a sulphur-based flux-cored wire for alloying with molten metal baths, comprising:

preparing a powder according to claim 1;

dispensing the powder by gravitational force onto a metal strip;

welding or mechanically folding the strip on itself in order to form the wire; and profiling the wire to the selected diameter so as to obtain a wire whose powder compactness is greater than or equal to 85%.

8. A sulfur-based flux-cored wire intended for alloying with a metal bath, comprising a powder according to claim 1, and a compaction rate of the powder within the wire is greater than or equal to 85%.

9. A method for producing a sulphur-based flux-cored wire, comprising:

preparing a powder by homogeneously admixing of two granulometric populations 1 and 2, granulometric population 1 constituting between 50 and 90% by mass of a resulting admixture and population 2 constituting between 10 and 50% by mass of the admixture, the populations being defined by:

Population 1:

350 μm≦d10≦1400 μm

650 μm≦d50≦2200 μm

1000 μm≦d90≦3000 μm

Population 2:

1 μm≦d10≦250 μm

50 μm≦d50≦500 μm

100 μm≦d90≦800 μm with d10, d50 and d90 being equivalent diameters of the particles for which values of the cumulative distributions are 10, 50 and 90% by mass, respectively, wherein a compaction rate of the powder within the wire is greater than or equal to 85%.

10. The method according to claim 9, wherein population 1 constitutes from 65 to 75% by mass of the admixture and population 2 constitutes from 25 to 35% by mass of the admixture.

* * * * *

UNITED STATES PATENT AND TRADEMARK OFFICE

CERTIFICATE OF CORRECTION

PATENT NO. : 8,221,519 B2
APPLICATION NO. : 12/760747
DATED : July 17, 2012
INVENTOR(S) : Andre Poulalion et al.

It is certified that error appears in the above-identified patent and that said Letters Patent is hereby corrected as shown below:

Title Page, Item (57) line 5, in the abstract, delete before figures "1", "200" and "500" " – ".

Title Page, Item (57) line 6, in the abstract, insert before "d50" and "d90" -- ≦ --.

In column 4, line 23, please change "x" before "d10" to read as -- ≦ --.

In column 4, line 27, insert before "d10" -- ≦ --.

In claim 1, column 10, lines 48-50, insert before "d10," "d50" and "d90" -- ≦ --.

Signed and Sealed this
Twelfth Day of March, 2013

Teresa Stanek Rea
*Acting Director of the United States Patent and Trademark Office*